United States Patent [19]

Stromme

[11] Patent Number: 4,593,864

[45] Date of Patent: Jun. 10, 1986

[54] DIFFERENTIAL MANDREL FOR SHEET-SLITTING MACHINE RECOILER

[75] Inventor: Sigurd J. Stromme, Holmestrand, Norway

[73] Assignee: Årdal Og Sunndal Verk A.S., Oslo, Norway

[21] Appl. No.: 694,118

[22] Filed: Jan. 23, 1985

[30] Foreign Application Priority Data

Jan. 25, 1984 [NO] Norway ..... 840274

[51] Int. Cl.[4] ..... B65H 18/08; B65H 15/24

[52] U.S. Cl. ..... 242/56.9; 242/56.4; 242/72 R

[58] Field of Search ..... 242/56.4, 56.5, 56.7, 242/72 R, 72 B, 72.1, 73, 46.2, 46.6, 56.9; 29/110, 113, 125, 130

[56] References Cited

U.S. PATENT DOCUMENTS

| | | | |
|---|---|---|---|
| 3,225,418 | 12/1965 | Fara | 29/113 |
| 3,289,966 | 12/1966 | Richel | 242/72 B |
| 3,817,468 | 6/1974 | Smolderen et al. | 242/56.9 |
| 4,026,491 | 5/1977 | Bostroem | 242/72 B |
| 4,218,029 | 8/1980 | Schwenzfier et al. | 242/56.9 |
| 4,220,291 | 9/1980 | Papa | 242/56.9 |
| 4,266,737 | 5/1981 | Mastriani | 242/72 B |
| 4,332,356 | 6/1982 | Damour | 242/72 B |

FOREIGN PATENT DOCUMENTS

| | | |
|---|---|---|
| 1804178 | 7/1970 | Fed. Rep. of Germany . |
| 2933775 | 2/1981 | Fed. Rep. of Germany . |

OTHER PUBLICATIONS

"Noncontacting Strip Tension System Provides Tight Coils", By William P. Rutledge, Sales Engineer, Stamco Sales, Inc., New Bremen, Ohio (Iron and Steel Engineer, Feb. 1971).

*Primary Examiner*—John M. Jillions

*Attorney, Agent, or Firm*—Wenderoth, Lind & Ponack

[57] ABSTRACT

When strips are cut from a coil of sheet material, they may differ in length because of differences in thickness across the sheet. These differences in length are accommodated by the slit strips being wound by separate rotational forces. Recoiler mandrels are divided into sections mounted on the same shaft and each having a hydraulic unit. Each hydraulic unit includes a pressure side and a suction side, the pressure sides of all of the hydraulic units being connected, and the suction sides of all of the units being connected, thereby forming a closed hydraulic system wherein increased pressure in one hydraulic unit due to increased tension on the respective mandrel section is balanced by the remaining hydraulic units and respective mandrel sections.

3 Claims, 7 Drawing Figures

DIFFERENTIAL MANDREL FOR SHEET-SLITTING MACHINE RECOILER

BACKGROUND OF THE INVENTION

This invention relates to an apparatus for recoiling metal strips which are produced when a coil of sheet metal is slit parallel to its longitudinal axis. Particularly when slitting large coils of thin sheet, metal uneven thickness over the width of the sheet will often result in the slit strips differing in length. It is usual when rolling metal sheet and metal foil that the thickness of the product varies across its width, and the result of this is that the metal strips which are cut along the length of the sheet are longer where the sheet is thin than where it is thicker. As a result, when several strips are recoiled into a common mandrel with the same rotational speed along its entire length, the coils containing the longest strips will be loosely wound.

German Auslegeschrift No. 2,933,775 attempts to solve this problem by dividing the recoiler mandrel into sections, so that it consists of a number of cylinders, or drums, suspended on a common shaft, friction blocks being placed inside the sections, so arranged that the friction can be varied by varying pneumatic or hydraulic pressure, enabling the sections, to a certain extent, to rotate at different speeds. This system requires a very exacting control of the pressure as the coils of strip build up. To avoid uneven strip tension, the operator will ensure that the friction surfaces for all the sections are continuously sliding against one another. This is difficult to achieve, and can result in surface scratches and uneven coiling.

A corresponding solution to the problem is that the friction elements consist of friction discs placed between the sections, the friction force being varied by pressing the sections together by axial hydraulic or pneumatic pressure. This solution also gives, in principle, different coiling tensions, and has the same disadvantages.

A third solution is discussed by N. P. Rutledge, "Iron and Steel Engineer", February 1971 pages 70–71. Here, constant coiling tension is achieved by means of magnetic braking of the coils, but to take care of the differences in length, an accommodating unit is required, and this is in the form of a deep pit in which the strip hangs in a loop. If the strips are long, the loop may hang several meters down into the pit. Furthermore, the friction element here can also result in surface damage.

SUMMARY OF THE INVENTION

The present invention provides having a number of mandrel sections rotatably suspended on a common shaft, and mounted on this common shaft there are hydraulic rotating units for the respective mandrel sections, with a gear transmission between each unit and section. Hydraulically, the pressure sides of all hydraulic rotating units are interconnected and the suction sides of all the hydraulic rotating units are interconnected, and in this way a differential effect is achieved.

When a rotational force is applied to one of the mandrel sections, the respective hydraulic unit (the motor) will be driven as a pump, and the oil pressure will drive the other units as motors in the opposite direction of rotation until all the sections are loaded with the same rotational force. The sum of the rotational speeds of the motors will be equal to that of the pump.

The hydraulic units thus function both as motors and as pumps, the pressure sides of all of the units being interconnected and the suction sides of all of the units are interconnected, so that when a rotational force in a given direction is applied to one or more sections, the remaining sections will be driven in the opposite direction in such a manner that the sum of the relative rotations of the mandrel sections with respect to the recoiler shaft is zero, and the rotational force applied to each section is approximately equal when transmission losses are disregarded. The system thus operates as a multiple differential mandrel.

When all the mandrel sections are loaded with an equally large rotational force, and rotate at the same r.p.m. as the shaft, the hydraulic system is in static balance, and the mandrel sections are stationary with respect to the shaft. Any changes in the r.p.m. of a unit in relationship to the others will bring the system out of static balance, and an acceleration of a unit will result in retardation of the other units.

BRIEF DESCRIPTION OF THE DRAWINGS

Other objects, features and advantages of the invention will be apparent from the following description, taken with the accompanying drawings, wherein.

DETAILED DESCRIPTION OF THE INVENTION

Figure 4:
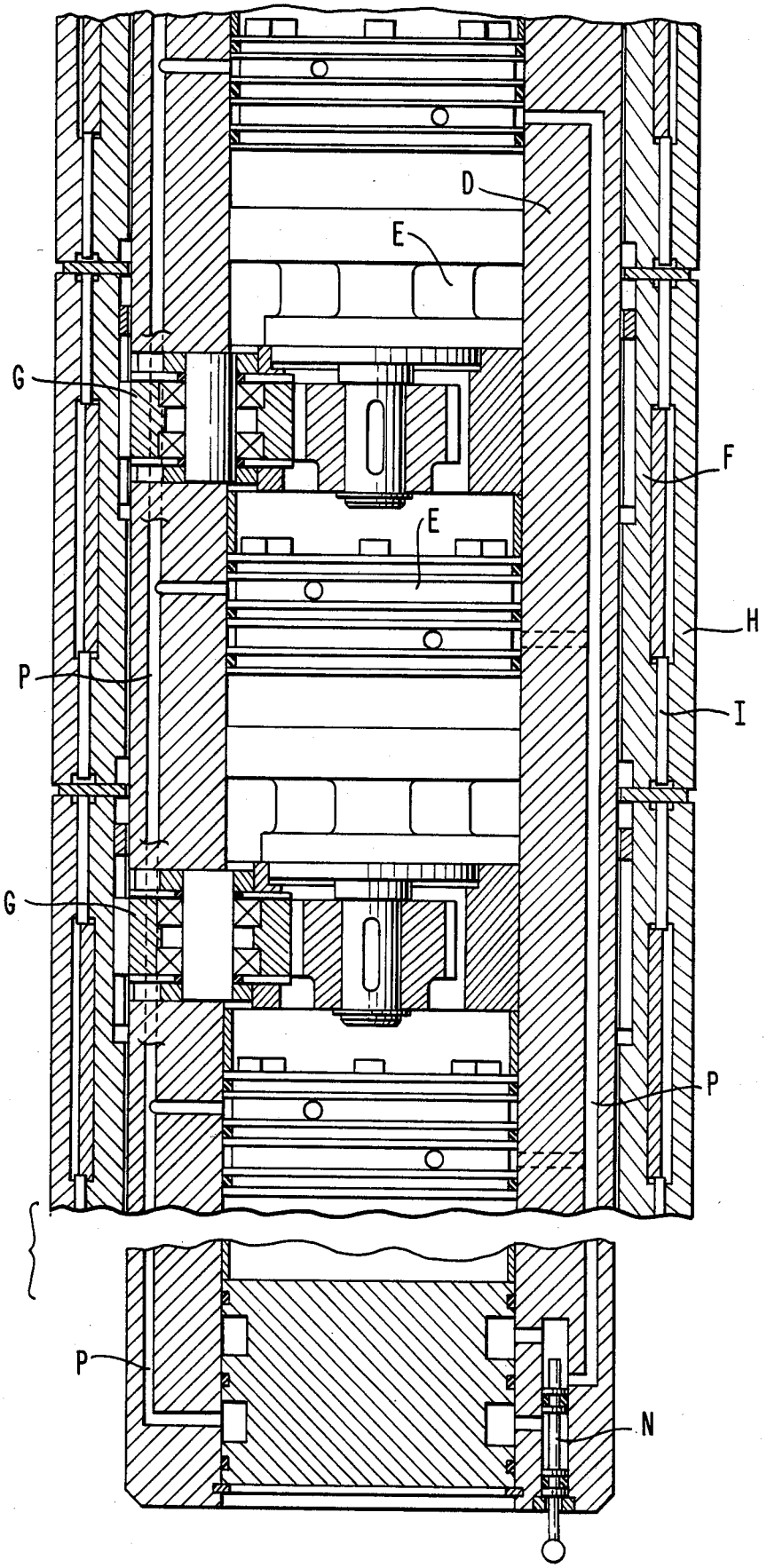
FIG. 4 is a longitudinal section of the device of FIG. 2, showing connection of hydraulic units of the mandrel sections thereof, and also showing a valve isolating the hydraulic unit of one mandrel section.

According to the invention, an apparatus has thus been designed for producing evenly and tightly wound coils A′ of strip cut from an initial coil 2 of sheet material, such as metal, slit parallel to its longitudinal axis, to form two or more strips in a conventional slitting machine 4. In such operation, any differences in the length of the strips A, arising from the slitting process, are accommodated by maintaining the strip tension of the plural strips approximately constant during recoiling. Each recoiling mandrel B employed with the slitting machine 4 is divided into plural mandrel sections mounted on a recoiler shaft. Each section C receives rotational force from a drive K via the recoiler shaft D and a hydraulic unit E fixed on the recoiler shaft. The hydraulic units of all of the mandrel sections are hydraulically linked, e.g. by conduits P (FIG. 4), thereby forming a closed hydraulic system.

Disregarding oil leakage, flow losses and the possible addition of hydraulic oil from an external source, such system will adjust itself to a state in which the sum of the relative rotational speeds of the mandrel sections C with respect to the shaft D is zero, and the rotational forces for all of the sections are the same.

Recoiling the strips A on their respective mandrel sections C will result in the strips being coiled at the same tension, independently of the individual strip lengths and resultant speeds.

Figure 1A:
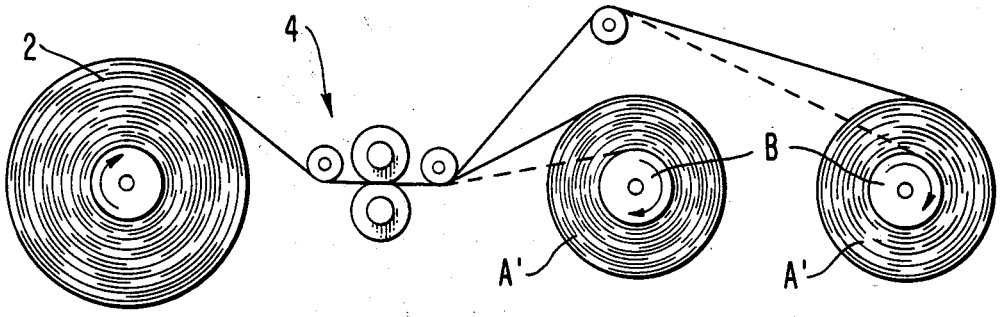
FIGS. 1A and 1B respectively are side elevation and plan views of a conventional sheet slitting machine equipped with recoil devices according to the present invention.
Figure 1B:
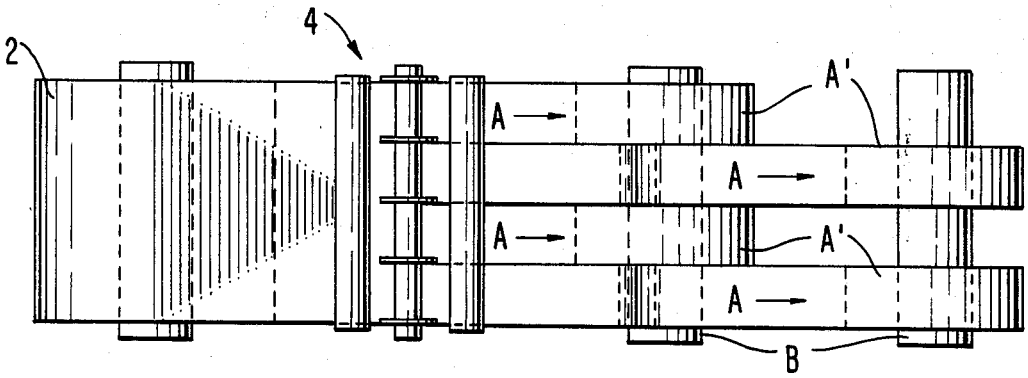
Figure 6:
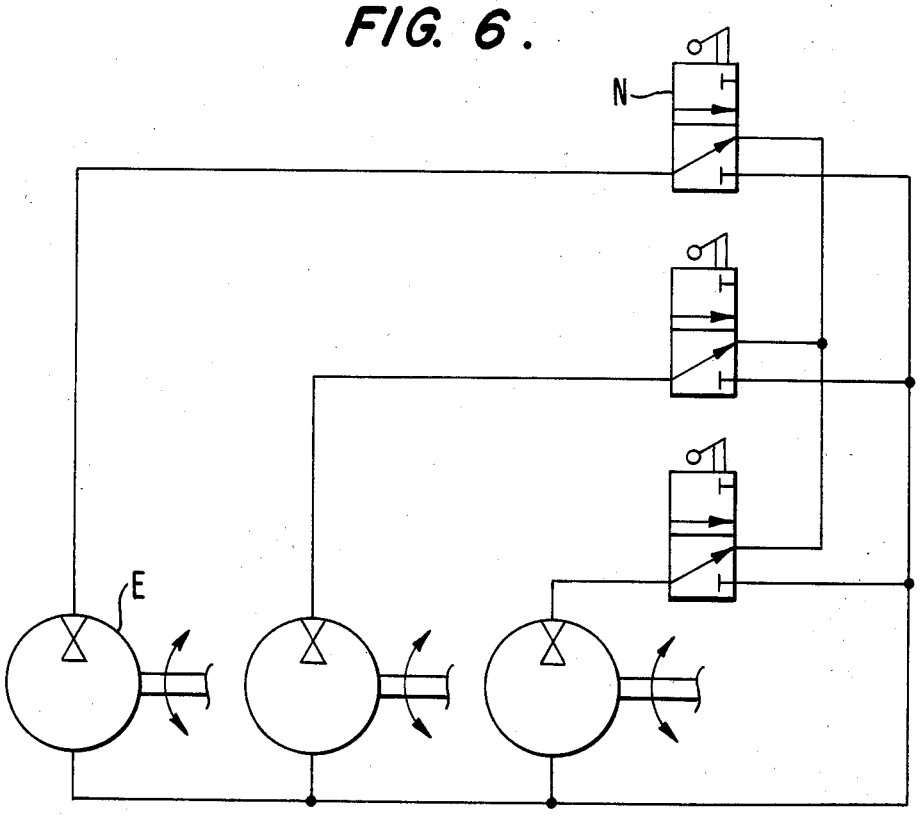
FIG. 6 is a schematic diagram of a closed hydraulic circuit formed by connecting the plural hydraulic units.
Figure 2:
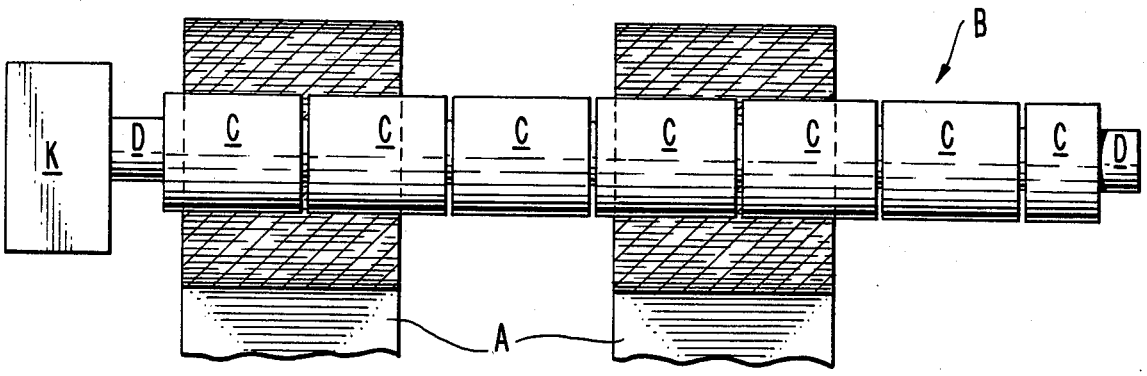
FIG. 2 is a schematic view of plural mandrel sections forming one recoil device of FIG. 1, with recoiled strips wound thereon shown in section.

FIGS. 1A and 1B illustrate slitting machine 4 equipped with two recoiler mandrels B, and with alternate strips A wound on respective recoiler mandrels B. FIG. 2 illustrates how, in accordance with the invention, each recoiler mandrel is divided into plural sections C on a common shaft D, and with two strips A of randomly selected widths wound on respective such mandrel sections.

Each recoiler B is divided into the plural mandrel sections C suspended on the recoiler shaft B, each section C receiving its rotational force from drive K via the recoiler shaft D, with power supplied via a respective hydraulic unit E fixed on the shaft D and hydraulically interlinked with corresponding units E for the remaining mandrel sections C, thus forming a closed hydraulic system.

Figure 3:
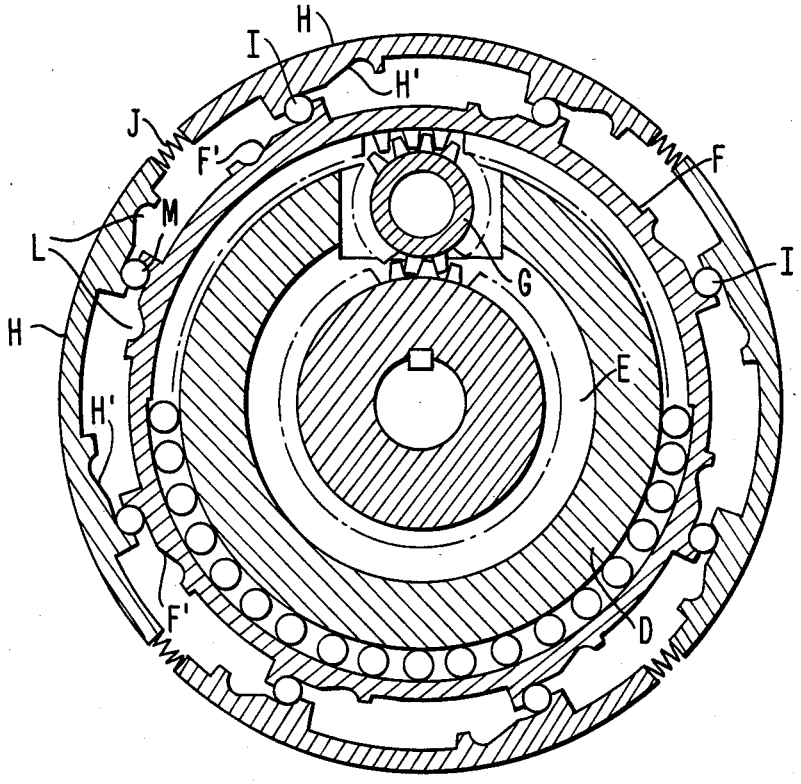
FIG. 3 is an enlarged cross-sectional view through one mandrel section of the device of FIG. 2.
Figure 5:
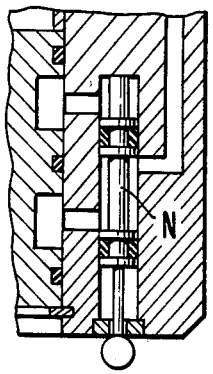
FIG. 5 is a detailed section showing the valve of FIG. 4 open.

FIG. 3 illustrates somewhat schematically the construction of each recoiler mandrel section C. A split outer expansion drum H and an inner drum F have respective inner and outer correspondingly inclined cam surfaces H', F', so shaped that the outer drum H will expand or contract radially between given diameters when it is rotated through given angles in opposite directions with respect to inner drum F, and the inclined surfaces H' and F' are displaced relative to one another due to contacting rollers I. If the expansion drum is rotated in the opposite direction as drum F and relative thereto, it will collapse radially inwardly due to springs J. Thus, outside the inner drum F is a split expansion drum H which, when it is rotated in the same direction as the recoiling tension but relative to the inner drum F, will expand to a given diameter due to mobile cylindrical rollers I moving from positions L to positions M in specially shaped grooves in the inner surface of the outer drum and the outer surface of the inner drum.

When outer drum H is rotated in the direction opposite to the expanding direction and relative to inner drum F, it will collapse to a smaller external diameter due to rollers moving from positions M toward positions L. With this compact design, the coils A' can be easily removed from the mandrel sections when recoiling is complete. The rotational force is imparted to each mandrel section C by a gear wheel G acting between internal teeth of drum F suspended on the mandrel shaft D and external teeth on hydraulic unit E.

The recoiler mandrels B are built with the appropriate number of sections C determined by the narrowest strip A which is to be coiled. Unused sections C in each recoiling unit can be made inoperative by operating hydraulic valves.

It is very probable that this design is suitable for aluminum strip in thicknesses down to foil thickness, for example, 5–10 microns, and for other metals, plastic strips, rolls of cloth and composites thereof.

I claim:

1. An apparatus for producing evenly and tightly wound rolled coils of strips cut from a coiled sheet of material which is slit parallel to the longitudinal dimension thereof by a slitting machine to form plural said strips, said apparatus comprising at least one recoiler mandrel for coiling thereon said strips, said recoiler mandrel comprising:

a recoiler shaft;

means for rotating said recoiler shaft in a recoiling direction;

plural independent mandrel sections mounted about said recoiler shaft at positions along the length thereof such that said strips are coiled about respective said mandrel sections, each said mandrel section including an inner drum mounted about said recoiler shaft and having internal teeth; and means, operably connected between said recoiler shaft and said mandrel sections, to maintain the tensions of said strips being coiled substantially equal by accommodating differences in length thereof, said means comprising plural hydraulic units mounted on said recoiler shaft and connected to respective said mandrel sections and responsive to the tension thereon due to said strips being coiled thereof, each said hydraulic unit including a pressure side and a suction side, said pressure sides of all said hydraulic units being connected, and said suction sides of all said units being connected, thereby forming a closed hydraulic system wherein increased pressure in one said hydraulic unit due to increased tension on the respective mandrel section is balanced by the remaining said hydraulic units and respective mandrel sections, each said hydraulic unit having external teeth, and further comprising gear wheels engaging said internal teeth of respective said inner drums and said external teeth of said hydraulic units for transmitting rotational forces therebetween, whereby the sum of rotations of all of said mandrel sections with respect to said recoiler shaft is zero, and the rotational forces of all said mandrel sections substantially are equal.

2. An apparatus as claimed in claim 1, further comprising valve means for isolating from said closed hydraulic system the respective said hydraulic units of any said mandrel sections not having coiled thereon a respective said strip.

3. An apparatus as claimed in claim 1, wherein each said mandrel section further comprises a split, radially expandible and contractible outer drum surrounding the respective said inner drum, said outer and inner drums having cooperating respective inner and outer inclined cam surfaces having therebetween roller members, whereby when said outer drum rotates in a first direction with respect to said inner drum said roller members act on said cam surfaces to expand said outer drum, and spring means for contracting said outer drum when said outer drum rotates in a second direction with respect to said inner drum.

* * * * *